US009278554B2

(12) United States Patent
Holtman et al.

(10) Patent No.: US 9,278,554 B2
(45) Date of Patent: Mar. 8, 2016

(54) PRINTER FOR FORMING AN INKJET IMAGE

(71) Applicant: Océ-Technologies B.V., Venlo (NL)

(72) Inventors: Lodewijk T. Holtman, Venlo (NL); Henricus A. M. Janssen, Venlo (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 14/686,982

(22) Filed: Apr. 15, 2015

(65) Prior Publication Data

US 2015/0298471 A1 Oct. 22, 2015

(30) Foreign Application Priority Data

Apr. 16, 2014 (EP) ..... 14164946

(51) Int. Cl.

| | |
|---|---|
| ***B41J 11/00*** | (2006.01) |
| ***B41J 11/04*** | (2006.01) |
| ***B41J 2/175*** | (2006.01) |
| ***B41J 2/01*** | (2006.01) |

(52) U.S. Cl.

CPC .. *B41J 11/04* (2013.01); *B41J 2/01* (2013.01); *B41J 2/17593* (2013.01); *B41J 11/001* (2013.01); *B41J 11/005* (2013.01); *B41J 11/0005* (2013.01); *B41J 11/00* (2013.01); *B41J 11/0085* (2013.01); *B65H 2404/1416* (2013.01)

(58) Field of Classification Search

CPC combination set(s) only.
See application file for complete search history.

(56) References Cited

U.S. PATENT DOCUMENTS

| | | | | |
|---|---|---|---|---|
| 5,163,674 | A | 11/1992 | Parks | |
| 5,850,233 | A * | 12/1998 | Otsuka et al. | 346/136 |
| 6,132,038 | A | 10/2000 | Szlucha | |
| 6,196,672 | B1 * | 3/2001 | Ito et al. | 347/88 |
| 7,090,419 | B2 * | 8/2006 | Satoh et al. | 400/641 |
| 8,210,674 | B2 * | 7/2012 | Sugahara | 347/104 |
| 2004/0160475 | A1 * | 8/2004 | Satoh et al. | 347/36 |
| 2006/0114302 | A1 * | 6/2006 | Holtman | 347/88 |
| 2011/0234724 | A1 | 9/2011 | Hoover et al. | |

FOREIGN PATENT DOCUMENTS

| | | |
|---|---|---|
| EP | 1 642 729 A1 | 4/2006 |
| EP | 1 661 723 A2 | 5/2006 |

* cited by examiner

*Primary Examiner* — Huan Tran
(74) *Attorney, Agent, or Firm* — Birch, Stewart, Kolasch & Birch, LLP

(57) ABSTRACT

The present invention relates to a printer for forming a phase change inkjet image. The printer comprises a platen comprising a print surface, an advancing mechanism adapted for moving a print substrate in a transport direction over the print surface and a print station adapted for providing the phase change inkjet image on a first surface of the print substrate in a print area of the print surface. The advancing mechanism comprises a plurality of feed nips, said plurality of feed nips being arranged upstream of the print surface. Each of said plurality of feed nips comprising a feed roller which comprises a main rotational axis, wherein each main rotational axis of said plurality of feed nips is aligned with respect to each other in a second direction, which second direction is substantially perpendicular to the transport direction. The advancing mechanism further comprises a star wheel. Said star wheel is arranged in between two adjacent feed nips in the second direction and faces a support surface. Said star wheel in printing operation is arranged in rolling contact with the first surface of the print substrate upstream of the print area in the transport direction of the print substrate and is adapted for urging the print substrate towards the support surface.

13 Claims, 6 Drawing Sheets

PRINTER FOR FORMING AN INKJET IMAGE

FIELD OF THE INVENTION

The present invention relates to a printer for forming an inkjet image having an advancing mechanism for a print substrate. The present invention further relates to a method for forming an inkjet image.

BACKGROUND OF THE INVENTION

In a phase change ink jet printer for printing an inkjet ink, a feed nip may be used as advancing mechanism for advancing a sheet of paper or any other print substrate in a transport direction over a print area of a print surface. The feed nip is defined by a feed roller and a pressure roller, wherein the feed roller is adapted for driving the sheet. In a typical setup of the phase change ink jet printer the print substrate is intermittently advanced over the print surface in the transport direction, while a carriage moves back and forth across the print substrate in a scanning direction normal to the transport direction and inkjet print heads are energized to eject droplets so as to form the phase change inkjet image on the print substrate in the print area. The phase change ink is solid or in gelled state at room temperature and must be heated above its phase change temperature before droplets of liquid ink can be jetted onto the print substrate.

A print substrate, which is provided from a roll, may be relatively stiff and may have a persistent roll curl directed towards the print surface while being advanced over the print surface. In case a leading edge of the print substrate arrives at the print surface during an advancing step, the leading portion of the print substrate may start bulging from the print surface. A bulging behavior of the print substrate from the print surface may lead to problems of obstructing the carriage or touching the print head.

Several measures can be conceived of in order to suppress the bulging of the print substrate. For example a suction pressure may be provided between the print surface and the print substrate. However especially in case of a bulging print substrate said suction pressure may largely vanish due to pressure leakage towards an edge of the print surface. In another example a stationary flap element extending in the scanning direction may be arranged in contact with said print substrate in order to urge the print substrate towards the print surface. However it has been observed that a contact of the stationary flap element to an outer surface of the print substrate upstream of the print area may lead to disturbance of the crystallization of the phase change ink applied on the print substrate in the print area. This disturbance of the crystallization may lead to the problem of a loss of an image quality of the phase change ink image.

SUMMARY OF THE INVENTION

It is accordingly an object of the present invention to provide a phase change ink printer, wherein said bulging of the print substrate is suppressed without disturbing an image quality of the phase change ink jet image.

This object is attained by a printer for forming a phase change inkjet image, the printer comprising:

a platen comprising a print surface;

an advancing mechanism adapted for moving a print substrate in a transport direction over the print surface; and a print station adapted for providing the phase change inkjet image on a first surface of the print substrate in a print area of the print surface;

the advancing mechanism comprising a plurality of feed nips, said plurality of feed nips being arranged upstream of the print surface, each of said plurality of feed nips comprising a feed roller which comprises a main rotational axis, each main rotational axis of said plurality of feed nips being substantially aligned with respect to each other in a second direction, which second direction is substantially perpendicular to the transport direction, wherein the advancing mechanism further comprises a star wheel, said star wheel being arranged in between two adjacent feed nips in the second direction and facing a support surface, said star wheel comprising an axis of rotation and a plurality of projections arranged for, in printing operation, being in rolling contact with the first surface of the print substrate upstream of the print area in the transport direction of the print substrate and being adapted for urging the print substrate towards the support surface, wherein each projection comprises a tip, which tip in printing operation is arranged in rolling contact with the first surface of the print substrate, wherein the tips have a substantially spherical shape having a mean diameter of at least 0.05 mm and at most 0.8 mm.

The star wheel of the advancing mechanism prevents or at least diminishes bulging of the print substrate from the print surface upstream of the print station. In particular the star wheel enhances initial flattening of the print substrate on said portion of the print surface thereby reducing leading edge curl of the print substrate.

Said star wheel in printing operation is arranged in rolling contact with the first surface of the print substrate upstream of the print area in the transport direction. The star wheel is freely rotatably around its main rotational axis. As defined herein a rolling contact is a contact of the tips of said projections of the star wheel with the print substrate wherein a transport of the print substrate along the star wheel drives a rotation of the star wheel around the main rotational axis in the same direction. The rolling contact of the tips of projections of the star wheel prevents or at least minimizes damaging of the first surface of the print substrate. For example a sliding contact of the star wheel with the first surface of the print substrate may cause scratches, which may become visible in an inkjet image, such as a phase change ink inkjet image. In fact it has been observed that a sliding contact of the star wheel with the first surface of the print substrate upstream of the print area may disturb a crystallization pattern of a phase change ink on the print substrate.

The phase change ink of the present invention may be a hotmelt ink, which is solid at room temperature, and may be a phase change ink for forming a gelled state at room temperature. In a particular example the phase change ink may be a curable phase change ink further comprising at least one curable component for curing the phase change ink, for example a radiation curable component, which is curable by applying a radiation, such as ultraviolet radiation.

The advancing mechanism is arranged upstream of the print station. The advancing mechanism advances the print substrate over the print surface. The advancing mechanism may advance the print substrate intermittently in advance steps.

Alternatively the advancing mechanism may advance the print substrate continuously over the print surface.

The print station is adapted for providing the inkjet image on the first surface of the print substrate in a print area of the print surface. The print station may comprise a plurality of inkjet print heads. Said inkjet print heads may be mounted on a carriage, wherein said carriage may be adapted for in printing operation scan-wise moving in the second direction over the print area of the print surface. Alternatively the inkjet print heads may be arranged page-wide extending over the print area in a width direction of the print substrate.

The advancing mechanism comprises a plurality of feed nips. Said plurality of feed nips may be evenly distributed over a width of the advancing mechanism in the second direction. Each feed nip may be formed by a feed roller and a pressure roller, said feed roller engaging the print substrate on a second surface of the print substrate for applying a driving force thereto, said pressure roller being arranged opposite to the feed roller and being urged towards the feed roller.

The star wheel is arranged facing the support surface. The support surface may be arranged adjacent to the platen and upstream of the platen in the transport direction of the print substrate. Alternatively the support surface may be a part of the platen.

In an embodiment the advancing mechanism may comprise a plurality of star wheels, for example a first star wheel and a second star wheel, being arranged in between two adjacent feed nips, wherein each star wheel is urged towards said portion of the print surface.

Said star wheel according to the invention may be a spur. Said star wheel comprises an axis of rotation and a plurality of projections. Said star wheel may comprise a cylinder supporting said plurality of projections. Said plurality of projections may for example be teeth and/or tips. Each projection projects from said axis of rotation in a radial direction. During rotation of the star wheel the projections may provide a rolling contact with the print substrate. Each projection comprises a contact surface at an outer edge of said projection in the radial direction. Said contact surface of each projection is in printing operation arranged in rolling contact with the first surface of the print substrate. Said contact surface may for example be an edge of a tooth or a tip of a (tapered) projection. Preferably said contact surface is a curved surface having a mean diameter of at least 0.05 mm perpendicular to the radial direction. More preferably the mean diameter may be at least 0.1 mm. In particular the mean diameter may be about 0.2 mm.

Preferably said contact surface is a curved surface having a mean diameter of at most 0.8 mm perpendicular to the radial direction.

In an embodiment, wherein the plurality of projections are teeth, each tooth extending in a radial direction and comprising an edge, which edge in printing operation is arranged in rolling contact with the first surface of the print substrate, wherein the edge has a convex shape having a mean diameter of at least 0.05 mm perpendicular to the radial direction. More preferably the mean diameter may be at least 0.1 mm. In particular the mean diameter may be about 0.2 mm.

In this embodiment the edge of the tooth provides the contact surface to the print substrate. The mean diameter of the edge enhances that the star wheel does substantially not disturb a crystallization pattern of a phase change ink on the print substrate, which phase change ink is applied on the first surface of the print substrate downstream of the star wheel in the transport direction.

More preferably the minimum of the mean diameter of the tips may be at least 0.1 mm.

In particular the mean diameter may be about 0.2 mm.

In this invention the tip of the projection provides the contact surface to the print substrate. In particular the substantially spherical shape of the contact surface may be a hemispherical shape. The spherical shape, such as the hemispherical shape, and the mean diameter of the tip enhances that the star wheel does substantially not disturb a crystallization pattern of a phase change ink on the print substrate, which phase change ink is applied on the first surface of the print substrate downstream of the star wheel in the transport direction.

In an embodiment, the support surface is a part of said platen and said star wheel and said part of the platen are arranged upstream of said print area in the transport direction of the print substrate.

In this embodiment said support surface being part of the platen is arranged upstream of the print area of the platen in the transport direction of the print substrate and said star wheel is arranged facing said part of the platen upstream of the print area in the transport direction of the print substrate. The star wheel supports flattening of the print substrate on said part of the platen upstream of the print area. In this embodiment the print substrate is flattened on the platen itself by the star wheel. In fact after flattening by the star wheel no transition of the print substrate is needed between the support surface and the platen.

In an embodiment, said support surface and said star wheel both at least partially extend in between said two adjacent feed nips in the second direction.

This provides the advantage that said star wheel may be arranged close to the feed nips in the transport direction, while facing said support surface. Furthermore in this embodiment the arrangement of the star wheel in the transport direction between the feed nip and the print area may be suitably selected based on the desired space of the print station.

In a particular embodiment the support surface is a part of said platen and said part of said platen extends in between said two adjacent feed nips in the second direction.

In an embodiment, said support surface comprises at least one suction hole, which is arranged in fluid communication to a suction source and wherein the at least one suction hole in printing operation is adapted for providing a suction pressure towards a second surface of the print substrate.

In this embodiment a flattening of the print substrate is further enhanced by the combination of the star wheel in rolling contact with the first surface of the print substrate and the suction pressure provided by the suction hole on the second surface of the print substrate. Said suction pressure provides a suction force, which draws the print substrate towards the print surface.

In an embodiment, said support surface comprises a recess configured as a suction chamber, wherein said recess is arranged in fluid communication to said suction hole. In this embodiment the recess acts as suction chamber which enlarges the area over which the suction pressure is provided towards the second surface of the print substrate. Furthermore the suction chamber may provide a buffer for the suction pressure. The recess may have the advantage that the suction force towards the first surface of the print substrate is increased.

In an embodiment, the advancing mechanism comprises a first star wheel and a second star wheel and wherein said recess extends substantially in the transport direction of the print substrate, and wherein said first star wheel is arranged between said recess and a first adjacent feed nip of said two adjacent feed nips in the second direction and said second star wheel is arranged between said recess and a second adjacent feed nip of said two adjacent feed nips in the second direction.

In this embodiment the direction of the recess further enhances the flattening of the leading portion of the print substrate. Furthermore in this embodiment the advancing mechanism comprises a first star wheel and a second star wheel. Said first star wheel urges a portion of the print substrate towards said portion of the print surface on one side of the recess in the second direction between said recess and said first adjacent feed nip and said second star wheel urges a portion of the print substrate towards said portion of the print surface on another side of the recess in the second direction between said recess and said second adjacent feed nip. The arrangement of the first star wheel and the second star wheel may enhance the flattening of the print substrate by restricting a leakage of the suction pressure towards an edge of the portion of the printing surface adjacent to the respective feed nip in the second direction.

In an embodiment, said star wheel is arranged upstream of said recess in the transport direction and is substantially aligned with the recess in the second direction.

In this embodiment the arrangement of said star wheel further enhances the flattening of the print substrate by urging a portion of the print substrate towards the recess.

In an embodiment, said star wheel is movably arranged with respect to a height direction, which height direction is substantially perpendicular to a plane of said support surface, and wherein said star wheel is spring loaded in the height direction towards said support surface.

In this embodiment said star wheel enhances flattening of the print substrate while providing flexibility for a variation in thickness of the print substrate.

In an embodiment, each feed nip is formed by a feed roller and a pressure roller, said feed roller engaging the print substrate on a second surface of the print substrate for applying a driving force thereto, said pressure roller being urged towards the feed roller, wherein each pressure roller comprises a textured outer surface, which textured outer surface in operation is arranged in rolling contact with the second surface of the print substrate, wherein the textured outer surface comprises a plurality of protrusions, which is provided by an assembly of spherical segments.

The plurality of protrusions provide in operation a plurality of small contact areas with the first surface of the print substrate compared to a smooth outer surface providing a single large contact area, while not intruding the first surface of the print substrate.

The spherical segments in the assembly are arranged adjacent to each other along the textured outer surface. The plurality of protrusions is provided by the spherical surfaces of the assembly of spherical segments.

This embodiment has particular advantage in a phase change printer. It has been found that said textured outer surface of the pressure roller prevent or at least diminish print artifacts, which print artifacts are caused by an irregular crystallization of a phase change ink.

The spherical segments may be balls, beads, half of balls, hemispheres or any other globular shapes, which provide a defined contact area. The spherical segments may provide a defined smooth contact area substantially independent of a variation of contact pressure in the feed nip of the advancing mechanism, thereby preventing intrusion of the print substrate by the protrusions.

In another aspect of the present invention a method is provided for forming a phase change inkjet image in a phase change inkjet printing apparatus, the phase change inkjet printing apparatus comprising a feed nip for advancing a print substrate, and a print surface comprising a print area, a star wheel comprising an axis of rotation and a plurality of projections, each projection comprising a tip, the method comprising the steps: advancing the print substrate by way of the feed nip in a transport direction over the print surface; urging the print substrate towards a support surface upstream of the print area in the transport direction, said urging step comprising arranging the tips of the star wheel in a rolling contact with a first surface of the print substrate upstream of the print area in the transport direction; and providing a phase change inkjet image on the first surface of the print substrate in the print area of the print surface; and wherein the tips have a substantially spherical shape having a mean diameter of at least 0.05 mm and at most 0.8 mm.

The method provides a flattening of the print substrate on the support surface upstream of the print area even in case of a roll curl occurring in the print substrate. Furthermore said method suppresses bulging of the print substrate on the support surface without disturbing an image quality of the phase change ink jet image.

In this method the inkjet image is provided on the first surface of the print substrate after the urging step, wherein the star wheel is in rolling contact with the first surface of the print substrate upstream of the print area in the transport direction.

The inkjet printing apparatus used is a phase change inkjet printing apparatus, and the providing step of the method comprises providing a phase change inkjet image on the first surface of the print substrate in the print area of the print surface.

In an embodiment, the urging step further comprises providing a suction pressure between said support surface and a second surface of the print substrate.

In this embodiment the flattening of the print substrate is further enhanced by the combination of the star wheel in rolling contact with the first surface of the print substrate and a suction pressure provided on the second surface of the print substrate. Said suction pressure provides a suction force, which draws the print substrate towards the support surface.

In a particular embodiment, the urging step comprises urging said star wheel against the print substrate towards said support surface adjacent to an edge of said support surface.

In this embodiment said star wheel urges a portion of the print substrate towards the support surface adjacent to an edge of said support surface. As a result any leakage of the suction pressure towards said edge of the support surface is reduced. The suction pressure provided between said support surface and the second surface of the print substrate is maintained due to a reduction of the leakage of the suction pressure. As such the cooperation between the urging star wheel and the suction pressure together enhances the flattening of the print substrate on the support surface.

In an embodiment, the urging step comprises urging the star wheel towards said support surface such that the star wheel does substantially not intrude the print substrate during the rolling contact with the first surface of the print substrate.

In this embodiment attributes of the star wheel are suitably selected such that in printing operation the star wheel does substantially not intrude the print substrate. As a result a disturbance of the crystallization of the phase change ink on the first surface of the print substrate is prevented or at least diminished. An attribute of the star wheel may for example be the shape of the parts of the star wheel, which parts are arranged in rolling contact with the first surface of the print substrate, and may in another example be the urging force of the star wheel against the print substrate in the direction of the support surface.

In particular the star wheel comprises tips, which tips in printing operation are arranged in rolling contact with the first surface of the print substrate, wherein the tips have a substantially spherical shape having a mean diameter of at least 0.05 mm and at most 0.8 mm. More preferably the mean diameter may be at least 0.1 mm. In particular the mean diameter may be about 0.2 mm. The advantage of the specific shape of the tips is that the star wheel do not disturb a crystallization pattern of a phase change ink on the print substrate, which phase change ink is applied downstream of the star wheel in the transport direction.

In an embodiment, said feed nip is formed by a feed roller and a pressure roller, said feed roller engaging the print substrate on a second surface of the print substrate for applying a driving force thereto, said pressure roller being urged towards the feed roller, wherein said pressure roller comprising a textured outer surface, said textured outer surface comprising a plurality of protrusions, which is provided by an assembly of spherical segments, and wherein step a) comprises arranging the textured outer surface of the pressure roller in rolling contact with the first surface of the print substrate such that the plurality of projections do substantially not intrude the print substrate.

In this embodiment both the star wheel and the pressure roller are adapted for guiding the first surface of the print substrate upstream of the print area towards the print surface without disturbing an image quality of the phase change ink jet image.

Further scope of applicability of the present invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given herein below and the accompanying schematical drawings which are given by way of illustration only, and thus are not limitative of the present invention, and wherein.

DETAILED DESCRIPTION OF EMBODIMENTS

Figure 1A:
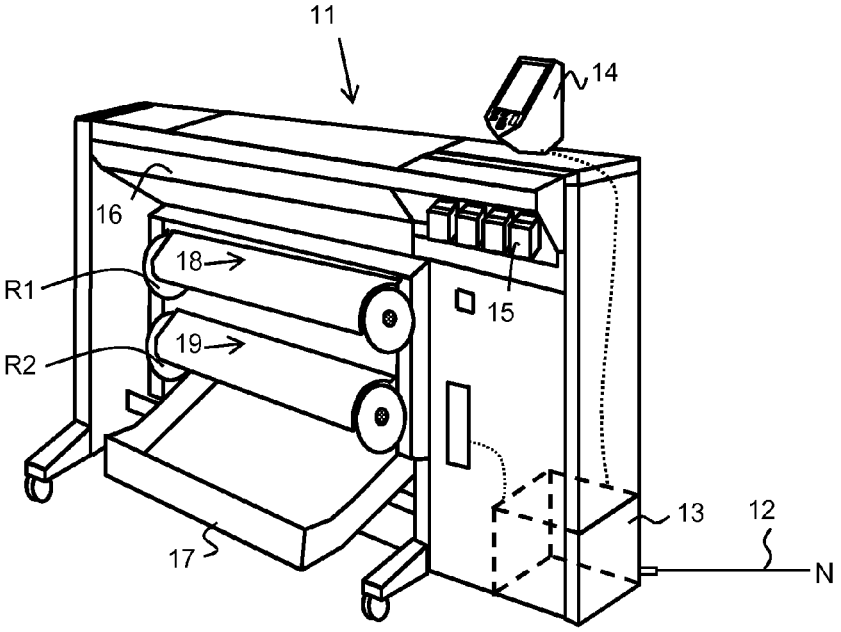
FIG. 1A shows an image forming apparatus, wherein printing is achieved using a wide format inkjet printer.

The present invention will now be described with reference to the accompanying drawings, wherein the same reference numerals have been used to identify the same or similar elements throughout the several views.

Figure 1B:
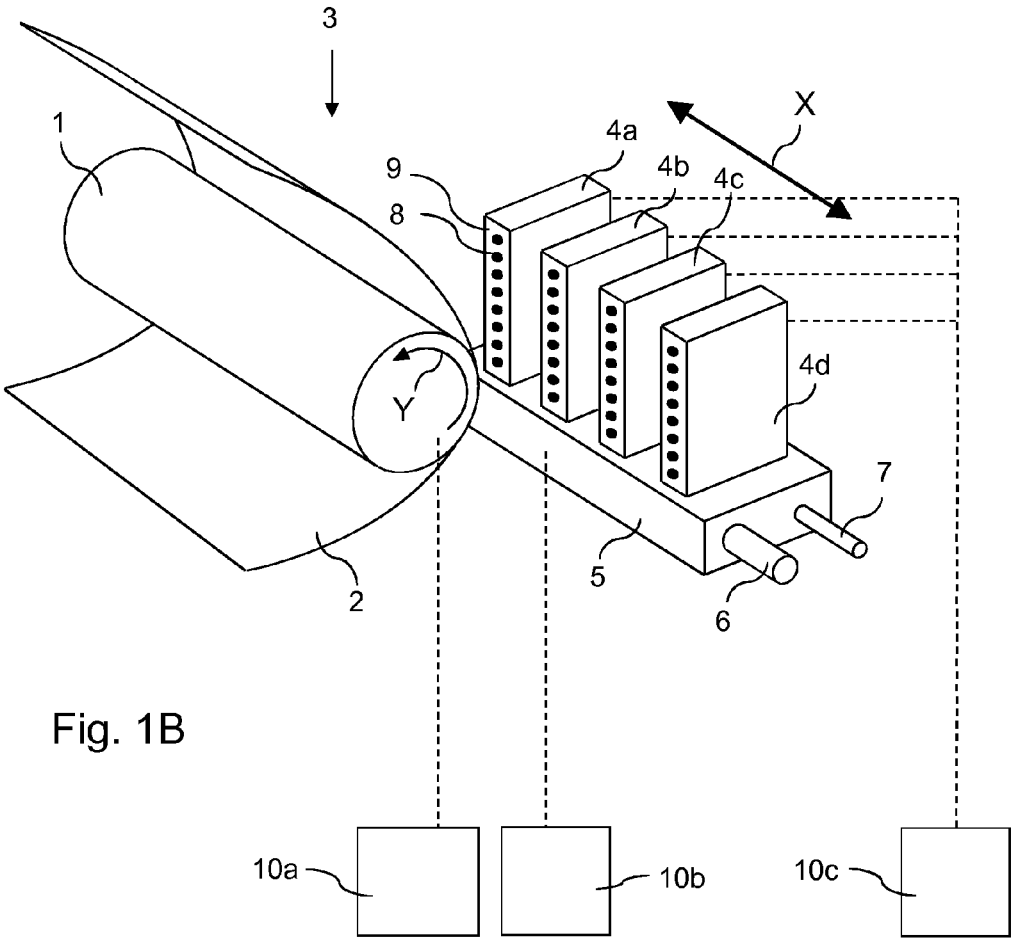
FIG. 1B shows an ink jet printing assembly.

FIG. 1A shows an image forming apparatus 11, wherein printing is achieved using a wide format inkjet printer. The wide-format image forming apparatus 11 comprises a housing 16, wherein the printing assembly, for example the ink jet printing assembly shown in FIG. 1B is placed. The image forming apparatus 11 also comprises a storage means for storing image receiving member 18, 19, a delivery station to collect the image receiving member 18, 19 after printing and storage means for marking material 15. In FIG. 1A, the delivery station is embodied as a delivery tray 17. Optionally, the delivery station may comprise processing means for processing the image receiving member 18, 19 after printing, e.g. a folder or a puncher. The wide-format image forming apparatus 11 furthermore comprises means for receiving print jobs and optionally means for manipulating print jobs. These means may include a user interface unit 14 and/or a control unit 13, for example a computer.

Images are printed on a image receiving member, for example paper, supplied by a roll 18, 19. The roll 18 is supported on the roll support R1, while the roll 19 is supported on the roll support R2. Alternatively, cut sheet image receiving members may be used instead of rolls 18, 19 of image receiving member. Printed sheets of the image receiving member, cut off from the roll 18, 19, are deposited in the delivery tray 17.

Each one of the marking materials for use in the printing assembly are stored in four containers 15 arranged in fluid connection with the respective print heads for supplying marking material to said print heads.

The local user interface unit 14 is integrated to the print engine and may comprise a display unit and a control panel. Alternatively, the control panel may be integrated in the display unit, for example in the form of a touch-screen control panel. The local user interface unit 14 is connected to a control unit 13 placed inside the printing apparatus 11. The control unit 13, for example a computer, comprises a processor adapted to issue commands to the print engine, for example for controlling the print process. The image forming apparatus 11 may optionally be connected to a network N. The connection to the network N is diagrammatically shown in the form of a cable 12, but nevertheless, the connection could be wireless. The image forming apparatus 11 may receive printing jobs via the network. Further, optionally, the controller of the printer may be provided with a USB port, so printing jobs may be sent to the printer via this USB port.

FIG. 1B shows an ink jet printing assembly 3. The ink jet printing assembly 3 comprises supporting means for supporting an image receiving member 2. The supporting means are shown in FIG. 1B as a platen 1, but alternatively, the supporting means may be a flat surface. The platen 1, as depicted in FIG. 1B, is a rotatable drum, which is rotatable about its axis as indicated by arrow Y. The supporting means may be optionally provided with suction holes for holding the image receiving member in a fixed position with respect to the supporting means. The ink jet printing assembly 3 comprises print heads 4*a*-4*d*, mounted on a scanning print carriage 5. The scanning print carriage 5 is guided by suitable guiding means 6, 7 to move in reciprocation in the main scanning direction B. Each print head 4*a*-4*d* comprises an orifice surface 9, which orifice surface 9 is provided with at least one orifice 8. The print heads 4*a*-4*d* are configured to eject droplets of marking material onto the image receiving member 2. The platen 1, the carriage 5 and the print heads 4*a*-4*d* are controlled by suitable controlling means 10*a*, 10*b* and 10*c*, respectively.

The image receiving member 2 may be a medium in web or in sheet form and may be composed of e.g. paper, cardboard, label stock, coated paper, plastic or textile. Alternatively, the image receiving member 2 may also be an intermediate member, endless or not. Examples of endless members, which may be moved cyclically, are a belt or a drum. The image receiving member 2 is moved in the sub-scanning direction Y by the platen 1 along four print heads 4*a*-4*d* provided with a fluid marking material.

A scanning print carriage 5 carries the four print heads 4*a*-4*d* and may be moved in reciprocation in the main scanning direction X parallel to the platen 1, such as to enable scanning of the image receiving member 2 in the main scanning direction B. Only four print heads 4*a*-4*d* are depicted for demonstrating the invention. In practice an arbitrary number of print heads may be employed. In any case, at least one print head 4*a*-4*d* per color of marking material is placed on the scanning print carriage 5. For example, for a black-and-white printer, at least one print head 4*a*-4*d*, usually containing black marking material is present. Alternatively, a black-and-white printer may comprise a white marking material, which is to be applied on a black image-receiving member 2. For a full-color printer, containing multiple colors, at least one print head 4*a*-4*d* for each of the colors, usually black, cyan, magenta and yellow is present. Often, in a full-color printer, black marking material is used more frequently in comparison to differently colored marking material. Therefore, more print heads 4*a*-4*d* containing black marking material may be provided on the scanning print carriage 5 compared to print heads 4*a*-4*d* containing marking material in any of the other colors. Alternatively, the print head 4*a*-4*d* containing black marking material may be larger than any of the print heads 4*a*-4*d*, containing a differently colored marking material.

The carriage 5 is guided by guiding means 6, 7. These guiding means 6, 7 may be rods as depicted in FIG. 1B. The rods may be driven by suitable driving means (not shown). Alternatively, the carriage 5 may be guided by other guiding means, such as an arm being able to move the carriage 5. Another alternative is to move the image receiving material 2 in the main scanning direction X.

Each print head 4*a*-4*d* comprises an orifice surface 9 having at least one orifice 8, in fluid communication with a pressure chamber containing fluid marking material provided in the print head 4*a*-4*d*. On the orifice surface 9, a number of orifices 8 is arranged in a single linear array parallel to the sub-scanning direction Y. Eight orifices 8 per print head 4*a*-4*d* are depicted in FIG. 1B, however obviously in a practical embodiment several hundreds of orifices 8 may be provided per print head 4*a*-4*d*, optionally arranged in multiple arrays. As depicted in FIG. 1B, the respective print heads 4*a*-4*d* are placed parallel to each other such that corresponding orifices 8 of the respective print heads 4*a*-4*d* are positioned in-line in the main scanning direction X. This means that a line of image dots in the main scanning direction X may be formed by selectively activating up to four orifices 8, each of them being part of a different print head 4*a*-4*d*. This parallel positioning of the print heads 4*a*-4*d* with corresponding in-line placement of the orifices 8 is advantageous to increase productivity and/or improve print quality. Alternatively multiple print heads 4*a*-4*d* may be placed on the print carriage adjacent to each other such that the orifices 8 of the respective print heads 4*a*-4*d* are positioned in a staggered configuration instead of in-line. For instance, this may be done to increase the print resolution or to enlarge the effective print area, which may be addressed in a single scan in the main scanning direction. The image dots are formed by ejecting droplets of marking material from the orifices 8.

Upon ejection of the marking material, some marking material may be spilled and stay on the orifice surface 9 of the print head 4*a*-4*d*. The ink, present on the orifice surface 9, may negatively influence the ejection of droplets and the placement of these droplets on the image receiving member 2. Therefore, it may be advantageous to remove excess of ink from the orifice surface 9. The excess of ink may be removed for example by wiping with a wiper and/or by application of a suitable anti-wetting property of the surface, e.g. provided by a coating.

Figure 2:
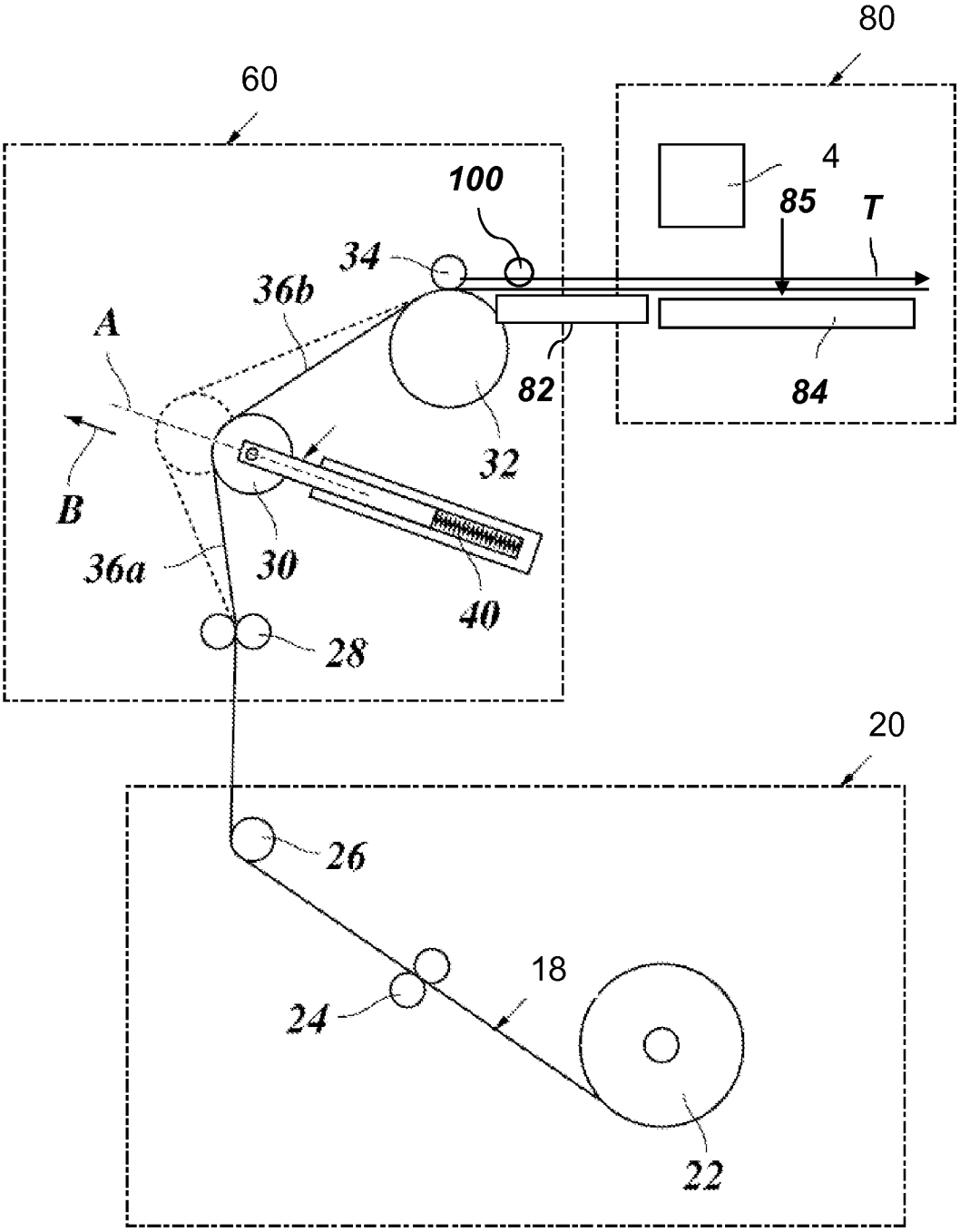
FIG. 2 is a diagram of a printer according to an embodiment of the present invention.

FIG. 2 is a diagram of a printer according to an embodiment of the present invention. The printer shown in FIG. 2 comprises a supply unit 20, a transport unit 60, a platen 84 and a print station 80. The supply unit 20 serves for the storage and delivery of a substrate 18 for printing. The transport unit 60 comprises a support surface 82 for supporting the substrate 18, which support surface 82 is arranged adjacent to the platen 84. The transport unit 60 transports the substrate 18 from the supply unit 20 in transport a direction as indicated by arrow T over the support surface 82 to the print station 80 and also provides for accurate positioning of the substrate in a print zone in the print station. The platen 84 comprises a print surface 85. In this embodiment, the print station 80 is a conventional ink jet engine which comprises a print head 4 arranged above the print surface 85 and adapted to move back and forth across the substrate 18 on the print surface 85 in a direction normal to the plane of the drawing in FIG. 2. The print head 4 has only a limited printing range, so that it is necessary to print the image on the substrate in different sub-images. To this end, the substrate 18 is advanced intermittently, and a sub-image or swath is printed in each interval between two subsequent advance steps. The increments by which the substrate 18 is advanced over the print surface 82 are precisely controlled, so that the sub-images will exactly adjoin to one another.

In the example shown, the substrate 18 comes from a roll 22 that is rotatably supported in the supply unit 20. The substrate 18 has the form of a web having a length 150 m, for example, which is wound on the roll 22. In the example shown, the printer is a large format printer, and the width of the web corresponds to the smaller side of a document in AO format. A pair of drive rollers 24 serves for drawing the substrate 18 off from the roll 22. The web drawn off from the roll is passed over a deflection roller 26 and is then paid out towards the transport unit 60.

In the transport unit 60, the web-type print substrate passes through a nip between a pair of rollers 28 forming a first feed unit, is deflected at a guide member 30 and is then passed on towards a feed nip of a second feed unit comprising a driven feed roller 32 and a pressure roller 34. The driven feed roller 32 controls the length of the increments with which the substrate 18 is advanced over the print surface 82.

A portion of the substrate 18 adjoining the feed roller 32 on the upstream side is divided by the guide member 30 into two sub-portions 36*a*, 36*b* forming an angle with one another. The guide member 30, which may be a roller or a stationary member, is movable along an axis A bisecting the angle between the sub-portions 36*a* and 36*b*, and the guide member is elastically biased in a direction indicated by an arrow B, so that the substrate portion 36*a*, 36*b* is held under a certain tension. Thus, the movable guide member 30 and its guide and biasing mechanism serve as a tensioning mechanism 38. In FIG. 1 the elastic bias of the guide member 30 has been symbolized by a compression spring 40.

In view of the fact that, on the one hand, the substrate 18 is advanced intermittently by the feed roller 32 and, on the other hand, the roll 22 in the supply unit 20 may have a considerable moment of inertia, so that large forces are required for accelerating and decelerating the same, one of the functions of the tensioning mechanism 38 in the transport unit 60 is to provide a buffer in the feed path of the web and to protect the web against successive strains. This buffer action may for example be accomplished as follows. When the feed roller 32 stops, the guide member 30 will be in the extended position, shown in phantom lines in FIG. 1 so that the length of the substrate portion 36*a*, 36*b* is comparatively large. Then, when a new advance step commences, the feed roller 32 starts to rotate with a comparatively large acceleration, whereas the roller pairs 24 and 28 accelerate the web with a smaller acceleration. As a result, a part of the length of the substrate portion 36*a*, 36*b* will be consumed, and the guide member 30 is moved against the biasing force of the spring 40 towards the position shown in continuous lines in FIG. 2. Conversely, at the end of the advance step, the feed roller 32 will be stopped relatively abruptly, whereas the roller pairs 24 and 28 will decelerate the web with a moderate deceleration. Consequently, the guide member 30 will move back towards the position shown in phantom lines, so as to eliminate a possible slack in the substrate portion 36*a*, 36*b*.

Figure 3A:
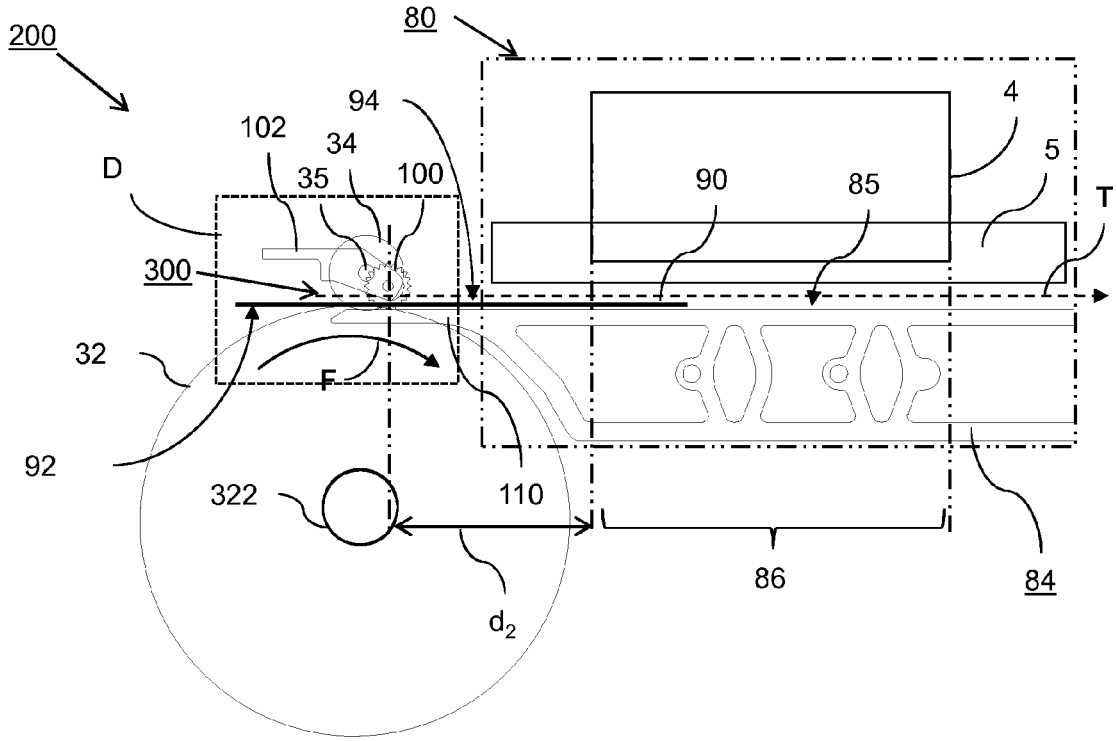
FIG. 3A illustrates an advancing mechanism of a printer according to an embodiment of the present invention.
Figure 3B:
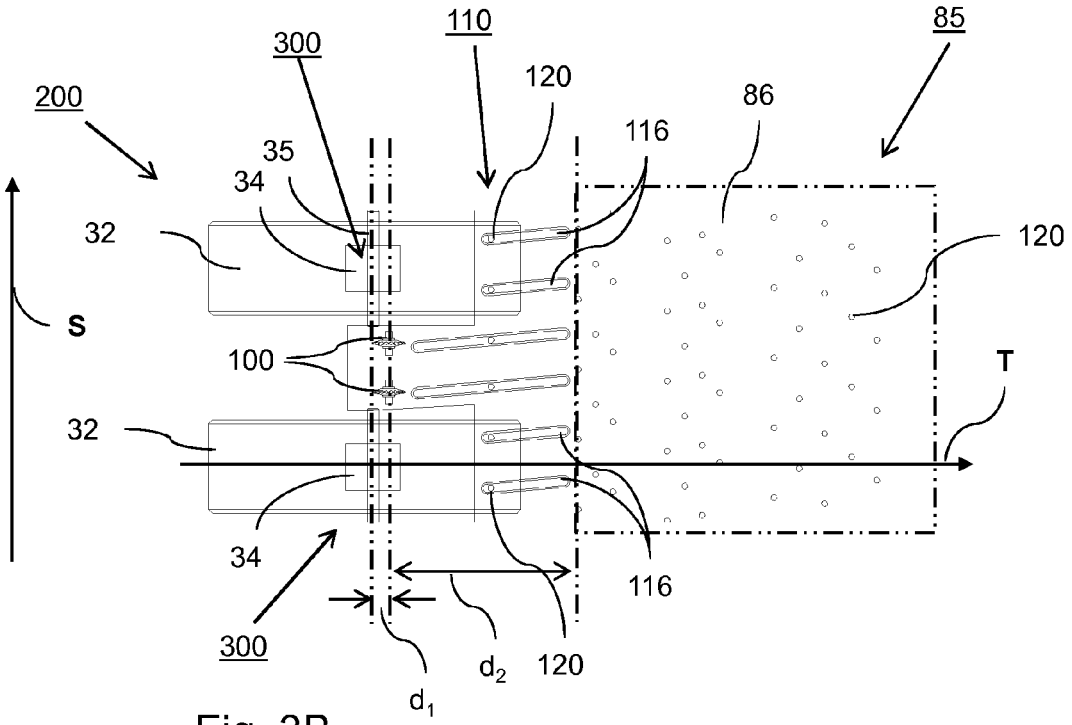
FIG. 3B illustrates a plan view of the embodiment shown in FIG. 3A.

In the present invention in the transport unit 60 a star wheel 100 is provided, which is arranged between the pressure roll 34 and the print station 80, the star wheel 100 is arranged facing the support surface 82. The star wheel 100 is urged towards the support surface 82. In FIGS. 3A and 3B another embodiment is shown of an advancing mechanism of a printer comprising said star wheel 100.

FIG. 3A and FIG. 3B illustrate an advancing mechanism of a phase change inkjet printer according to another embodiment of the present invention. The printer comprises a platen 84. Said platen comprises a print surface 85 and a support surface 110. The advancing mechanism 200 shown in FIG. 3A comprises a plurality of feed nips 300, each feed nip 300 being provided by a feed roller 32 and a pressure roller 34. The advancing mechanism 200 is part of the transport unit 60, which is shown in FIG. 2. The plurality of feed nips 300 is adapted for transporting a print substrate 90 in a transport direction T over a print surface 85. The plurality of feed nips 300 is arranged upstream of a print station 80 in the transport direction T. The print station 80 comprises a carriage 5 for supporting a number of inkjet print heads 4. The print heads 4 are arranged facing a print area 86 of the print surface 85. The support surface 110 of the platen 84 is arranged upstream from the print surface 85 in the transport direction T.

Each of the feed rollers 32 is driven by a rotational feed axle 322 in a main rotational axis direction F in order to advance the print substrate 90 in the transport direction T. Each of the main rotational axis of the rotational axle 322 is aligned with respect to each other in a second direction S (as shown in FIG. 3B), which second direction is substantially perpendicular to the transport direction T (and is perpendicular to the plane of viewing of FIG. 3A).

The feed roller 32 engages the print substrate 90 on a second surface 92 of the print substrate 90 for applying a driving force thereto. The pressure roller 34 is mounted on an axle 35, which pressure roller 34 is arranged opposite to the feed roller 32 facing a first surface 94 of the print substrate 90 and is urged towards the feed roller 32. The advancing mechanism 200 further comprises a star wheel 100, which is arranged facing the support surface 110. In printing operation the star wheel 100 is arranged facing the first surface 94 of the print substrate 90.

Figure 3C:
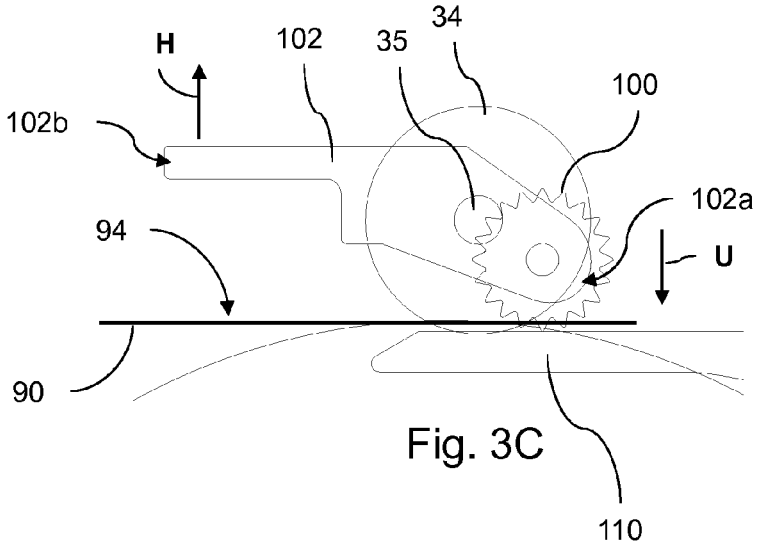
FIG. 3C shows a detail D of the advancing mechanism shown in FIG. 3A.

FIG. 3C shows a detail D of the advancing mechanism shown in FIG. 3A. As shown in FIG. 3C said star wheel 100 is mounted on a first end 102*a* of a supporting element 102. The supporting element 102 is rotatably mounted on the axle 35 of the pressure roller 34. The supporting element 102 is spring loaded at a second end 102*b*, opposite to the first end 102*a*, in a height direction indicated by arrow h in order to urge the star wheel 100 at the first end 102*a* towards the first surface 94 of the print substrate 90. The star wheel 100 is movably in the height direction h at the first end 102*a* of the supporting element 102, thereby providing flexibility for a thickness of the print substrate 90. For example a preload of the star wheel 100 on the support surface 110 is in the range 0-0.5 N. And a normal force urging towards a first surface 94 of the print substrate 90 is in the range 0.5-2.0 N when the star wheel is lifted 1 mm in the height direction h with respect to the support surface 110. In case the normal force of the star wheel 100 is higher than 2.0 N contact marks of the star wheel 100 on the first surface 94 of the print substrate may become visible in inkjet images which are provided by the print station 80 downstream of the star wheel 100 in the transport direction T.

The star wheel 100 is arranged in between two adjacent feed nips 300 in the second direction S as can be seen in FIG. 3B, thereby facing the support surface 110. In the embodiment as illustrated in FIG. 3B two star wheels 100 are arranged in between two adjacent feed nips 300 and are aligned with respect to each other in the second direction S. For simplicity the supporting element 102 is not shown in FIG. 3B. The two star wheels 100 are arranged offset of the feed nips 300 in the transport direction T downstream of the feed nips 300, upstream of the print area 86 and upstream of the carriage 5 of the print station 80. Each of the star wheels 100 is arranged adjacent to an edge of said support surface 110 in the second direction near one of the feed nips 300. Said support surface 110 is partly extending between two adjacent feed nips 300. The print area 86 comprises suction holes 120 for holding the print substrate 90, wherein the ink jet print heads are adapted to provide an inkjet image on the first surface 94 of the print substrate 90 in said print area 86. Said support surface 110 comprises suction holes 120 and groove shaped recesses 116, wherein each recess 116 is arranged in fluid connection to a suction hole 120. The recesses 116 extend substantially in the transport direction T. Each star wheel 100 is arranged near an end portion of a recess 116 in the transport direction T. A flattening of the print substrate 90 is enhanced by the combination of the star wheel 100 in rolling contact with the first surface of the print substrate 94 and a suction force provided by the suction hole 120 via the recess 116 on the second surface of the print substrate 92. In particular the arrangement of the star wheel 100 near the end portion of the recess 116 enhances the flattening of the print substrate 90 on said recess 116 of said support surface 110 upstream of the print area 86 in cooperation with the suction force provided by the recess 116.

The star wheel 100 is arranged at a distance $d_1$ downstream from the feed nip 300 in the transport direction T, while the star wheel 100 is arranged at a distance $d_2$ upstream from the print area 86 in the transport direction T. The distance $d_1$ is smaller than $d_2$. The distance $d_2$ is suitably selected for providing space for the carriage 5, which extends from the print area 86 in the direction of the advancing mechanism 200 over a part of said support surface 110 as is schematically illustrated in FIG. 3A.

The star wheel 100 comprises tips, which tips are arranged in operation of the star wheel 100 in rolling contact with the first surface 94 of the print substrate 90. The tips have a hemispherical shape having a mean diameter of about 0.2 mm. It is found that said tips do not disturb a crystallization pattern of a hotmelt ink, which hotmelt ink is a phase change ink forming a solid phase at room temperature, which hotmelt ink is applied on the first surface 94 of the print substrate 90 in the print area downstream of the star wheel 100 in the transport direction T.

In an alternative embodiment (not shown) each star wheel of the two star wheels 100 is arranged between said recess 116 and one of the feed nips 300 in the second direction. A first star wheel 100 may be arranged adjacent to a first feed nip of the two adjacent feed nips 300 and a second star wheel 100 may be arranged adjacent to a second feed nip of the two adjacent feed nips 300. In this embodiment the first star wheel and second star wheel may be aligned with each other in the second direction.

FIGS. 4A-4D illustrate star wheels according to the present invention.

Figure 4A:
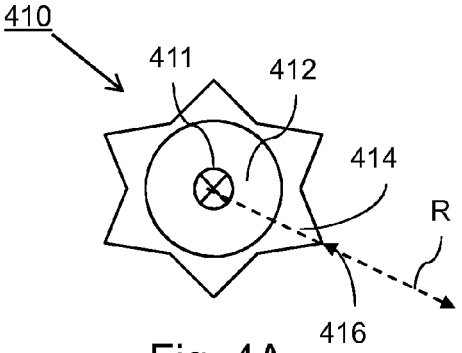
FIGS. 4A-4D illustrate star wheels according to the present invention.
Figure 4B:
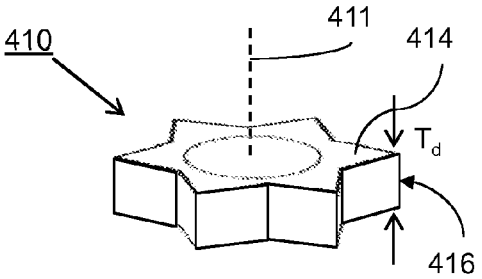

In FIG. 4A a side view is shown of a star wheel 410. In FIG. 4B a perspective view is shown of the star wheel 410 shown in FIG. 4A. The star wheel 410 comprises a cylinder 412 and six teeth 414 projecting radially from the cylinder 412. Each of the six teeth 414 have a straight edge 416, which is aligned parallel to an axis of rotation 411 of the star wheel 410. Each of the six teeth 414 has a thickness $T_d$ perpendicular to the radial direction R, which is substantially equal to a thickness of the cylinder 412 in the same direction. Preferably the edge 416 has a convex shape perpendicular to the radial direction R, wherein the convex shape has a mean diameter of at least 0.05 mm. The mean diameter of the convex edges 416 enhances that the star wheel does substantially not disturb a crystallization pattern of a phase change ink on the print substrate, which phase change ink is applied on the first surface of the print substrate downstream of the star wheel in the transport direction.

The number of teeth 414 is merely an example. Any number of teeth 414 of the star wheel may be suitably selected by a person skilled in the art.

In printing operation the star wheel 410 is freely rotatable around its axis of rotation 411. The edges 416 of the teeth 414 provide a contact surface to the print substrate.

Figure 4C:
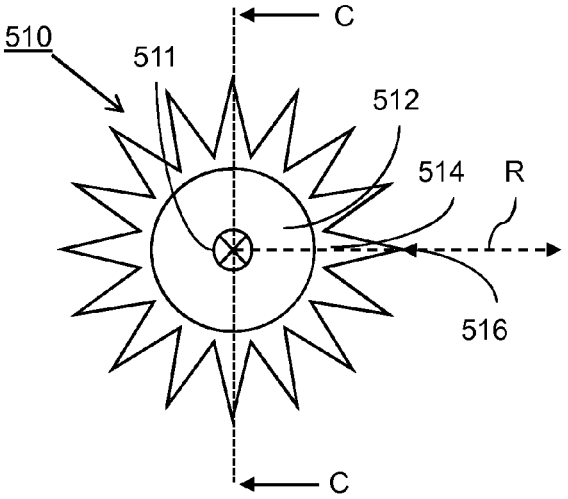
Figure 4D:
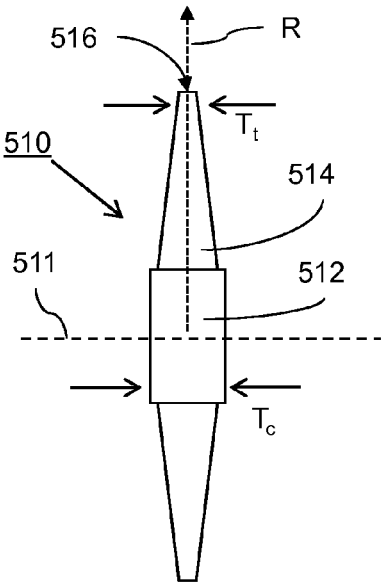

In FIG. 4C a side view is shown of another star wheel 510. In FIG. 4D a cross section view is shown of the star wheel 510 shown in FIG. 4C. The cross section is taken along the line C-C in FIG. 4C. The star wheel 510 comprises an axis of rotation 511, a cylinder 512 and six teen tapered projections 514 projecting radially from the cylinder 512. Each of the tapered projections 514 have a tip 516 arranged at an outer edge in the radial direction R. Each of the tips 516 has a thickness T near the outer edge in the direction of the axis of rotation 511, which is substantially smaller than a thickness $T_c$ of the cylinder 512 in the same direction (i.e. the axis of rotation 511).

Each of said tip 516 has a hemispherical shape, wherein the tips have a substantially hemispherical shape having a mean diameter of at least 0.05 mm. The mean diameter of the tips enhances that the star wheel does substantially not disturb a crystallization pattern of a phase change ink on the print substrate, which phase change ink is applied on the first surface of the print substrate downstream of the star wheel in the transport direction.

In printing operation the star wheel 510 is freely rotatable around its axis of rotation 511. The tips 516 of the tapered projections 514 provide a contact surface to the print substrate.

Based on the above examples a person skilled in the art may easily contemplate alternative star wheels having suitable projections, such as teeth and tapered projections, and contact surfaces having suitable shapes.

Figure 5A:
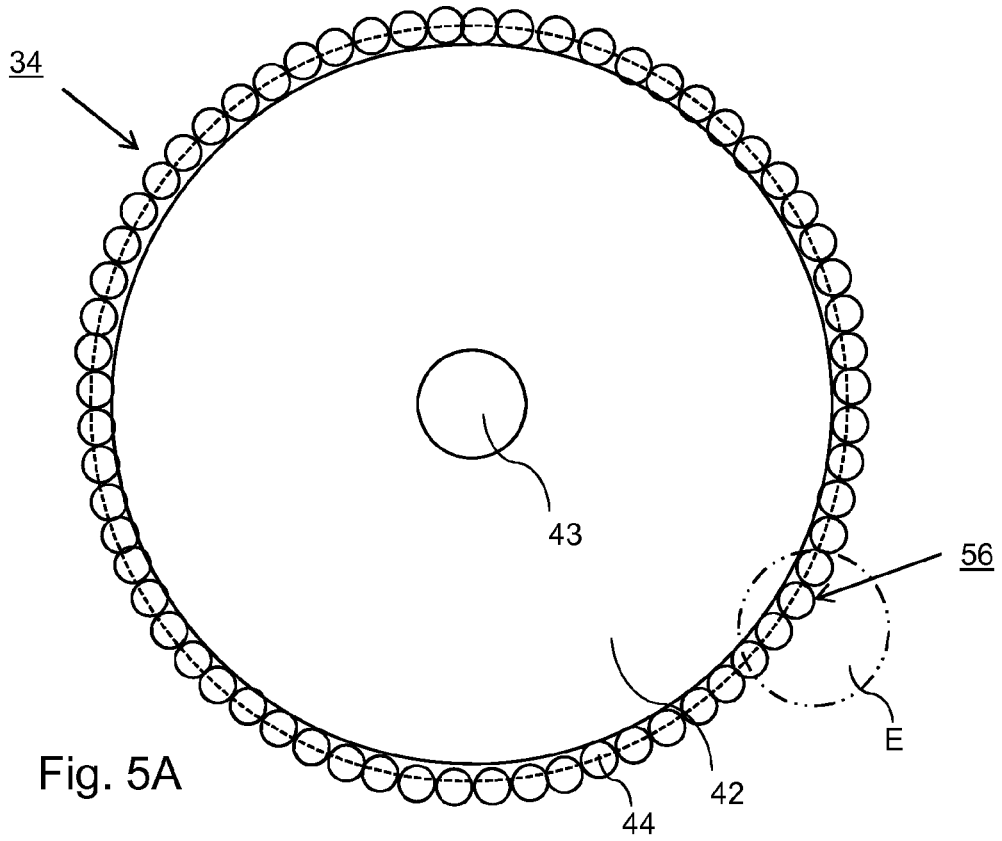
FIG. 5A shows a cross section of an embodiment of the pressure roller according to the present invention.

In an embodiment of the present invention the pressure roller 34 has a textured outer surface, which outer surface is in rolling contact with a first surface of the print substrate. In FIG. 5A is shown a cross section of an embodiment of the pressure roller according to the present invention. The Pressure roller 34 comprises a base roller 42 and an outer surface layer 44 (or film). The base roller 42 is freely rotatable mounted around axis 43. The outer surface layer 44 comprises an assembly of glass beads 56.

Figure 5B:
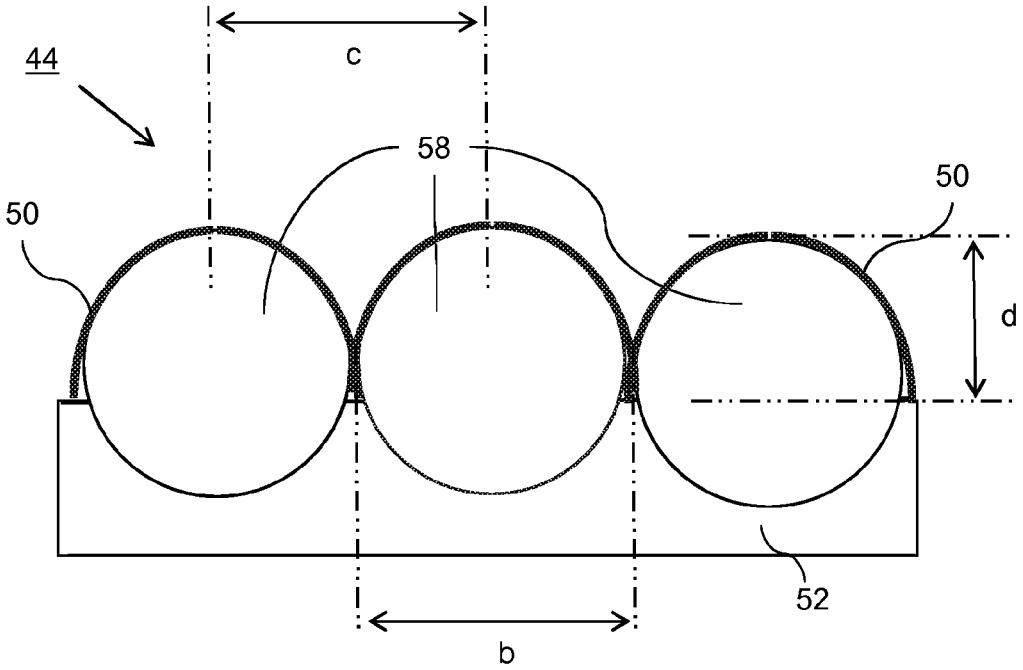
FIG. 5B illustrates an enlarged portion E of the outer surface layer of the pressure roller shown in FIG. 5A.

FIG. 5B illustrates an enlarged portion E of the outer surface layer of the pressure roller shown in FIG. 5A. Each glass bead 58 is substantially spherical. The diameter of the glass bead 58 is indicated by arrow b. The beads in the assembly 46 are arranged adjacent to each other, thereby forming a single layer of beads having a dense matrix packing. Each of the beads 58 provides a small contact area with a print substrate. The distance between adjacent contact areas is schematically indicated by arrow c. The assembly of beads 56 is coated by a single layer coating 50, which is substantially conformal to the outer surface of the glass beads 58, or is coated by a multiple layer coating structure. The single layer coating 50 is an silicon coating, an adhesive coating, or any other suitable coating for retaining the glass beads 58 in the assembly of beads 56. The multiple layer coating structure (not shown) comprises a silicon coating, preferably a silicon top coating, an adhesive coating, and optionally a primer coating for bonding the silicon top coating to the adhesive coating. Any of the coatings may optionally provide an ink and/or oil resistant layer. The assembly of beads 56 is embedded in a base layer 52, which provides adhesion to the beads 58. Each of the beads 58 provides a protrusion which extends from the base layer 52 over a distance as indicated by arrow d. The base layer 52 further provides flexibility to the surface layer 44. This is for example useful when the surface layer 44 is handled in the form of a film when being applied onto the outer surface of the base roller 34.

The glass beads 58 in the assembly of glass beads 56 have a mean diameter in the range between 0.05 mm and 0.8 mm. In table I is shown how the mean diameter of the glass beads effects the crystal size distribution of the hotmelt ink image in an area which has been contacted by the pressure roller. A reference gloss level is provided by a crystal size distribution shown in FIG. 6A for an area of the inkjet image, which area of the print substrate has not been contacted by the pressure roller 34. The crystal size distribution is symmetrical around crystal size 0.1 mm (type A).

Figure 6A:
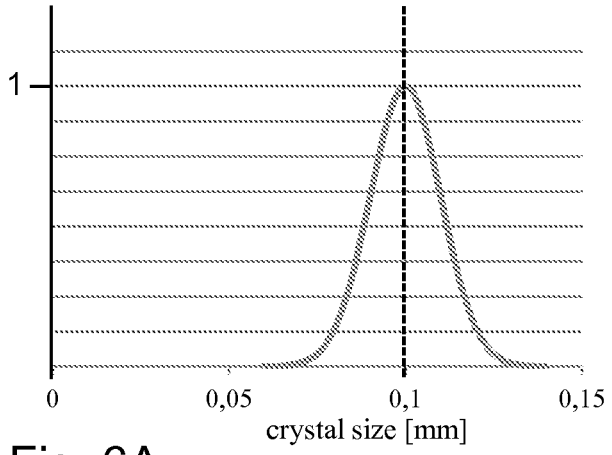
FIG. 6A illustrates a crystal size distribution of type A, providing the reference gloss level of the image.
Figure 6B:
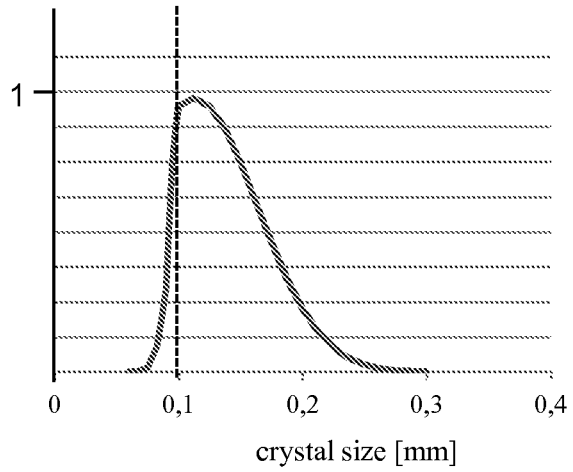
FIG. 6B illustrates a crystal size distribution of type C, wherein the gloss of the image is visibly diminished.

In case a pressure roller 34 has a smooth outer surface, the crystal size distribution is asymmetric as is shown in FIG. 6B, wherein larger crystals are formed having crystal sizes up to 0.3 mm (type C). The gloss of the image is visibly diminished.

Figure 6C:
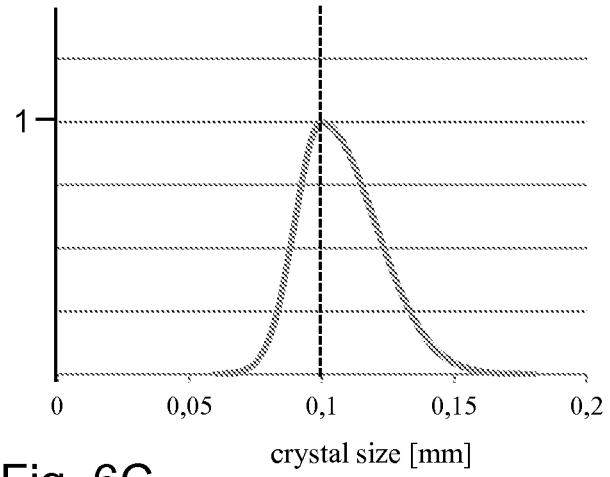
FIG. 6C illustrates a crystal size distribution of type B, wherein effects on gloss level become slightly visible in the image.

The crystal size distribution is not affected by a pressure roller 34 and is similar to the symmetrical distribution shown in FIG. 6A, in case the glass bead size is in the range between 0.1 mm and 0.4 mm (type A). No effects on gloss marks are seen. The crystal size distribution becomes slightly affected by a pressure roller 34 in case the glass bead size is around 0.05 mm or is around 0.8 mm (type B). In this case the crystal size distribution is slightly asymmetrical, having some crystals larger than 0.15 mm as is shown in FIG. 6C. Effects on gloss level become slightly visible.

TABLE I crystallisation distribution type depending on glass bead size used to texture the outer surface of the pressure roller

| Glass bead size [mm] | Crystal distribution type |
|---|---|
| <0.05 | C |
| 0.05 | B |
| 0.1 | A |
| 0.2 | A |
| 0.3 | A |
| 0.4 | A |
| 0.8 | B |
| >0.8 | C |

The glass beads provide a defined contact area with the print substrate. The glass beads also prevent an intrusion of the surface of the print substrate. A person skilled in the art may easily contemplate similar globular and/or hemispherical segments which could provide a suitable textured outer surface as disclosed in the present invention.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims are herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A printer for forming a phase change inkjet image, the printer comprising:

a platen comprising a print surface;

an advancing mechanism adapted for moving a print substrate in a transport direction over the print surface; and a print station adapted for providing the phase change inkjet image on a first surface of the print substrate in a print area of the print surface;

the advancing mechanism comprising a plurality of feed nips, said plurality of feed nips being arranged upstream of the print surface, each of said plurality of feed nips comprising a feed roller which comprises a main rotational axis, each main rotational axis of said plurality of feed nips being substantially aligned with respect to each other in a second direction, which second direction is substantially perpendicular to the transport direction, the advancing mechanism further comprising a star wheel, said star wheel being arranged in between two adjacent feed nips in the second direction and facing a support surface, said star wheel comprising an axis of rotation and a plurality of projections arranged for, in printing operation, being in rolling contact with the first surface of the print substrate upstream of the print area in the transport direction for urging the print substrate towards the support surface, wherein each projection comprises a tip, which tip in printing operation is arranged in rolling contact with the first surface of the print substrate, wherein the tips have a substantially spherical shape having a mean diameter of at least 0.05 mm and at most 0.8 mm.

2. The printer according to claim 1, wherein each projection projects from said axis of rotation substantially in a radial direction.

3. The printer according to claim 1, wherein the support surface is a part of said platen and wherein said star wheel and said part of the platen are cooperatively arranged upstream of said print area in the transport direction of the print substrate.

4. The printer according to claim 1, wherein said support surface and said star wheel both at least partially extend in between said two adjacent feed nips in the second direction.

5. The printer according to claim 1, wherein said support surface comprises at least one suction hole, which is arranged in fluid communication to a suction source and wherein the at least one suction hole in printing operation is adapted for providing a suction pressure towards a second surface of the print substrate.

6. The printer according to claim 5, wherein said support surface comprises a recess configured as a suction chamber, wherein said recess is arranged in fluid communication to said suction hole.

7. The printer according to claim 6, wherein the advancing mechanism comprises a first star wheel and a second star wheel and wherein said recess extends substantially in the transport direction of the print substrate, and wherein said first star wheel is arranged between said recess and a first adjacent feed nip of said two adjacent feed nips in the second direction and said second star wheel is arranged between said recess and a second adjacent feed nip of said two adjacent feed nips in the second direction.

8. The printer according to claim 6, wherein said star wheel is arranged upstream of said recess in the transport direction and is substantially aligned with the recess in the second direction.

9. The printer according to claim 1, wherein said star wheel is movably arranged with respect to a height direction, which height direction is substantially perpendicular to a plane of said support surface, and wherein said star wheel is spring loaded in the height direction towards said support surface.

10. The printer according to claim 1, wherein each feed nip is formed by a feed roller and a pressure roller, said feed roller engaging the print substrate on a second surface of the print substrate for applying a driving force thereto, said pressure roller being urged towards the feed roller, wherein each pressure roller comprises a textured outer surface, which textured outer surface in operation is arranged in rolling contact with the second surface of the print substrate, wherein the textured outer surface comprises a plurality of protrusions, which is provided by an assembly of spherical segments.

11. A method for forming an phase change inkjet image in an phase change inkjet printing apparatus, the phase change inkjet printing apparatus comprising a platen comprising a print surface, a feed nip for advancing a print substrate, said print surface comprising a print area, a star wheel comprising an axis of rotation and a plurality of projections, each projection comprising a tip, the method comprising the steps:

a) advancing the print substrate by way of the feed nip in a transport direction over the print surface;

b) urging the print substrate towards a support surface upstream of the print area in the transport direction, said urging step comprising arranging the tips of the star wheel in a rolling contact with a first surface of the print substrate upstream of the print area in the transport direction; and c) providing a phase change inkjet image on the first surface of the print substrate in the print area of the print surface;

and wherein the tips have a substantially spherical shape having a mean diameter of at least 0.05 mm and at most 0.8 mm.

12. The method according to claim 11, wherein step b) further comprises providing a suction pressure between said support surface and a second surface of the print substrate.

13. The method according to claim 11, wherein step b) comprises urging the star wheel towards said support surface such that the star wheel does substantially not intrude the print substrate during the rolling contact with the first surface of the print substrate.

* * * * *